United States Patent [19]

Lari et al.

[11] Patent Number: 4,905,756

[45] Date of Patent: Mar. 6, 1990

[54] ELECTROMAGNETIC CONFINEMENT AND MOVEMENT OF THIN SHEETS OF MOLTEN METAL

[75] Inventors: Robert J. Lari, Aurora; Walter F. Praeg, Palos Park; Larry R. Turner, Naperville, all of Ill.

[73] Assignee: United States Department of Energy, Washington, D.C.

[21] Appl. No.: 259,389

[22] Filed: Oct. 18, 1988

[51] Int. Cl.[4] ..... B22D 27/02

[52] U.S. Cl. ..... 164/467; 164/503

[58] Field of Search ..... 164/466, 467, 502, 503

[56] References Cited

U.S. PATENT DOCUMENTS 4,607,681 8/1986 Tinnes ..... 164/453
4,762,653 8/1988 Senillou ..... 264/22

FOREIGN PATENT DOCUMENTS 2396612 2/1979 France .
57-177861 11/1982 Japan .
60-106651 6/1985 Japan .
62-104653 5/1987 Japan .

*Primary Examiner*—Kuang Y. Lin
*Attorney, Agent, or Firm*—Paul A. Gottlieb; Frank J. Kozak; William R. Moser

[57] ABSTRACT

An apparatus capable of producing a combination of magnetic fields that can retain a metal in liquid form in a region having a smooth vertical boundary including a levitation magnet that produces low frequency magnetic field traveling waves to retain the metal and a stabilization magnet that produces a high frequency magnetic field to produce a smooth vertical boundary. As particularly adapted to the casting of solid metal sheets, a metal in liquid form can be continuously fed into one end of the confinement region produced by the levitation and stabilization magnets and removed in solid form from the other end of confinement region. An additional magnet may be included for support at the edges of the confinement region where eddy currents loop.

39 Claims, 12 Drawing Sheets

CALCULATED FORCE VARIATION OF THE LEVITATION MAGNET (FIG.3) AND THE EDGE SUPPORT MAGNET (FIG.4)

ELECTROMAGNETIC CONFINEMENT AND MOVEMENT OF THIN SHEETS OF MOLTEN METAL

CONTRACTUAL ORIGIN OF THE INVENTION

The United States Government has rights in this invention under Contract No. W-31-109-ENG-38 between the U.S. Department of Energy and the University of Chicago, operator of Argonne National Laboratory.

BACKGROUND OF THE INVENTION

This invention relates generally to the confinement of molten metal and is particularly directed to the casting of metal sheets using an electromagnetic field to form the casting mold.

Steel making occupies a central economic role and represents a significant fraction of the energy consumption of many industrialized nations. The bulk of steel making operations involves the production of steel plate and sheet. Present steel mill practice typically produces thin steel sheets by pouring liquid steel into a mold, whereupon the liquid steel solidifies upon contact with the cold mold surface. The solidified steel leaves the mold either as an ingot or as a continuous slab after it is cooled typically by water circulating within the mold wall during a solidification process. In either case, the solid steel is relatively thick, e.g., 6 inches or greater, and must be subsequently processed to reduce the thickness to the desired value and to improve metallurgical properties. The mold-formed steel is usually characterized by a surface roughened by defects, such as cold folds, liquation, hot tears and the like which result primarily from contact between the mold and the solidifying metallic shell. In addition, the steel ingot or sheet thus cast also frequently exhibits considerable alloy segregation in its surface zone due to the initial cooling of the metal surface from the direct application of a coolant. Subsequent fabrication steps, such as rolling, extruding, forging and the like, usually require the scalping of the ingot or sheet prior to working to remove both the surface defects as well as the alloy deficient zone adjacent to its surface. These additional steps, of course, increase the complexity and expense of steel production.

Steel sheet thickness reduction is accomplished by a rolling mill which is very capital intensive and consumes large amounts of energy. The rolling process therefore contributes substantially to the cost of the steel sheet. In a typical installation, a 10 inch thick steel slab must be manipulated by at least ten rolling machines to reduce its thickness. The rolling mill may extend as much as one-half mile and cost as much as $500 million.

Another approach to forming thin metal sheets involves casting into approximately the final desired shape. Compared to current practice, a large reduction in steel sheet total cost and in the energy required for its production could be achieved if the sheets could be cast in near net shape, i.e. in shape and size closely approximating the final desired product. This would reduce the rolling mill operation and would result in a large savings in energy.

There are several technologies currently under development which attempt to achieve these advantages by using an electromagnetic field to form the steel sheet in the casting process. Some of the approaches under investigation use electromagnetic energy entirely, and others use electromagnetic energy in conjunction with a solid mold on one or both sides of the sheet. For example, the use of electromagnetic levitation techniques has been employed in the aluminum industry. The practice there is to use electromagnetic fields to contain the top inch or so of a large, thick ingot. The molten aluminum is cooled and solidified before it touches any mechanical support. Examples of this approach can be found in U.S. Pat. Nos. 3,467,166 to Getselev, 4,161,206 to Yarwood et al., and 4,375,234 to Pryor. Other examples are U.S. Pat. Nos. 4,678,024 to Hull et al. and 4,741,382 to Hull et al. The Hull patents describe use of alternating electromagnetic fields to levitate an entire sheet of molten metal for horizontal casting.

There are several difficulties associated with the use of electromagnetic fields as a substitute for solid wall molds. Such difficulties include high energy requirements, large eddy currents, instabilities, and shaping the electromagnetic field to conform to the desired shape of the mold. For example, the Getselev patent describes a device for electromagnetic confinement of a metal, in particular aluminum, as it is cast into rods. The Getselev device employs metallic rings which form screens located at specific positions around the molten metal. These screens serve to shape and modify the magnetic field. A frequency of the alternating field in Getselev is chosen to make the skin depth about $\frac{1}{3}$ of the horizontal distance to the center. Eddy currents are generated in the molten aluminum to interact with the applied field and produce a containing force at the surface. In addition to these desirable eddy currents in the aluminum, the Getselev device also sets up currents in the ring and screen. These currents are responsible for shaping the field but result in large power losses. In addition, the large magnetic fields in the air near the caster may interfere with other equipment and may be a safety hazard.

Another example of an electromagnetic casting process is U.S. Pat. No. 4,414,285, "Continuous Metal Casting Method, Apparatus and Product", by H. R. Lowry et al., Nov. 8, 1983. Lowry et al. describes a continuous casting process which a single magnet with AC conducting coils carries three-phase, high frequency current and produces a magnetic field which partially levitates and confines a molten metal cylinder. The Lowry device applies the levitating force only at the surface of the cylinder. Moreover, the process of Lowry is not moldless. The confining force reduces but does not eliminate the pressure of the molten metal on the mold.

Another of the previous methods is described in the aforementioned patents by Hull, et al. The Hull patents describe how molten steel could be poured through and solidified in an electromagnetic caster in a horizontal geometry. A horizontal geometry has the advantage of low eddy currents but the stability of the molten metal in the field can be weak.

The stability problems of horizontal casting can be overcome by vertical casting. With vertical casting, a metal could be cast in a vertical position with a high frequency spatially varying magnetic field equalizing the ferrostatic pressure head at each vertical position. A disadvantage of the vertical casting method is that when applied to thin sheets, very high frequencies are required and a large amount of heating is generated.

Accordingly, an objective of the present invention is to provide a magnetic field which can retain a molten metal with smooth, even vertical boundary suitable for casting.

A further objective of this invention is to electromagnetically cast steel sheet with a minimum of electromagnetic heating of the molten and solid steel and to provide a casting system with the molten metal in stable mechanical equilibrium within the caster.

A further objective of this invention is to produce an electromagnetic levitation method that combines the low heat production of horizontal casting with the strong stability of vertical casting.

Another object of this invention is to produce steel sheet that requires little or no rolling after the casting operation.

Still another object is to produce steel that has good metallurgical properties and a good surface quality directly upon leaving the caster.

A still further object is to cast molten steel in such a manner that the surface skin solidifies without mechanical contact with a mold or roller.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects of the present invention, this disclosure provides an apparatus and method that combine a levitation magnet that produces low frequency magnetic field traveling waves with a stabilization magnet that produces a high frequency magnetic field to retain a metal in liquid form with a smooth vertical boundary. As particularly adapted to the casting of solid metal sheets, a metal in liquid form can be continuously fed into one end of the confinement region produced by the levitation and stabilization magnets and removed in solid form from the other end of the confinement region. An additional magnet may be included for support at the edges of the confinement region where eddy currents loop.

DETAILED DESCRIPTION OF THE INVENTION

Figure 1:
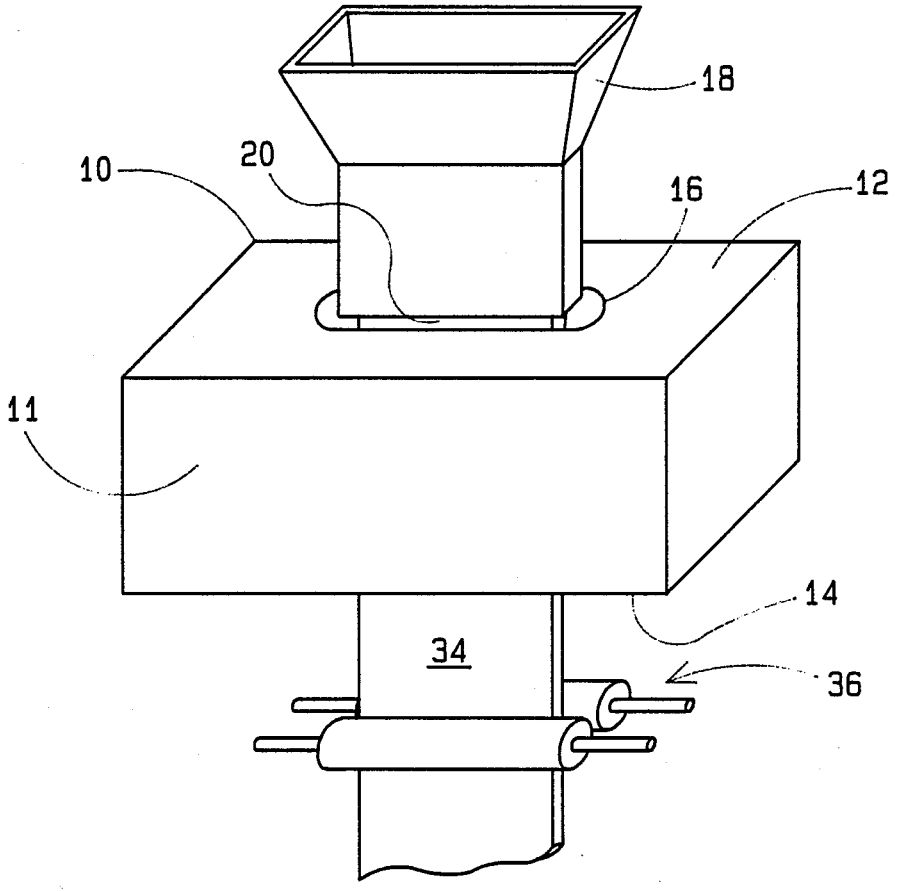
FIG. 1 depicts the present invention as adapted to a process for the continuous casting of solid metal sheets.

The present invention achieves the aforementioned objectives and addresses the difficulties previously associated with electromagnetic casting by combining different magnetic fields to accomplish specific tasks. The present invention combines a low frequency traveling magnetic field to levitate the molten metal with a high frequency magnetic field to smooth and stabilize the molten metal. The low frequency traveling magnetic field produces in the molten metal a body force that reduces or cancels the ferrostatic pressure head, or may be used to push the metal upwards against gravity. The effect is similar to that of a linear synchronous motor, used to propel trains and other devices. On the other hand, the high frequency magnetic field is used to define the smooth surface of the molten metal and confine and stabilize the molten metal within that surface. The frequency of this high frequency field is chosen so as to produce a skin depth in the molten metal that is only a small fraction of the thickness of the molten metal sheet. In the preferred embodiment of the invention, the high frequency field is spatially uniform over the surface of the metal.

The present invention utilizes two types of magnetic fields to act as a "magnetic pipe" in a casting process. The first magnetic field is a high frequency magnetic field parallel to the molten steel surface producing eddy currents in the surface of the steel which create inwardly directed forces on the surface. This high frequency magnetic field confines the liquid metal in the same way as an ordinary solid pipe, hence the term "magnetic pipe". A second magnetic field, this one being a low frequency magnetic field perpendicular to the steel surface and traveling in a direction parallel to the surface creates body forces throughout the steel. These forces act in the direction of the traveling magnetic field and offset the forces of gravity.

Accordingly, the present invention confines a molten metal by providing a combination of magnetic fields that can retain molten metal with a smooth even vertical boundary. It is therefore suitable for use in a casting process wherein the magnetic field serves as a mold wall or boundary to retain the molten metal while it solidifies. Because the magnetic field provides a frictionless boundary to retain the molten metal, the present invention can be adapted to a continuous metal casting process wherein molten metal is contiguously fed into the region defined by the magnet fields and continuously removed from the region after it solidifies.

The starting point for establishing the basis of the design of the present invention is that alternating current in a magnetic coil produces magnetic fields and eddy currents in the molten and solidifying steel. Further, these eddy currents and magnetic fields interact to produce confining forces. Starting from the basic equation for the Lorentz force, F, an electric current and a magnetic field interact in accordance with the equation:

$$F = IL \times B$$

where F is the Lorentz Force, I is total current, L is length of conductor and B is magnetic field. If the current is distributed, with current density J, then the force per unit area can be written:

$$\frac{F}{A} = \int_{x_1}^{x_2} J\,B\,dx$$

where $x_2$ is a point on the surface of the steel and $x_1$ is a point deep in the interior of the steel. From Maxwell's equation for current density:

$$J = \frac{1}{\mu_o}\ \frac{\partial B}{\partial x}$$

where $\mu_o$ is the permeability of free space. Substituting for J then provides:

$$\frac{F}{A} = \frac{1}{\mu_o} \int_{x_1}^{x_2} B \frac{\partial B}{\partial x}\,dx = \frac{B_2^2}{2\mu_o} - \frac{B_1^2}{2\mu_o}$$

If the field B at the interior point $x_1$ is zero, and the field $B_2$ at the surface point $x_2$ is called B, then $$\frac{F}{A} = \frac{B^2}{2\mu_o}$$

where B is high frequency magnetic field (also called magnetic induction or flux density), parallel to the surface of the molten metal. $B^2/2\mu_o$ can be defined as the magnetic pressure, $p_m$.

Unless there is a levitating force as described below, the ferrostatic pressure $p_y$ exerted by the molten pool of metal increases linearly with increasing downward distance y from the surface of the pool $$p_y = g\rho y$$

where $\rho$ is the density of the metal, and g is the acceleration of gravity. The magnetic pressure exerted by the magnetic field must balance the static pressure everywhere from the region where the liquid metal enters the magnet to the region where a shell of metal has solidified sufficiently thick to withstand the static pressure. Therefore, the magnetic pressure, $p_m$, must balance the ferrostatic pressure, $p_y$;

$$p_m = p_y$$

and substituting for $p_m$ and $p_y$:

$$\frac{B^2}{2\mu_o} = g\,\rho\,y$$

From this, it follows that in the absence of a levitating force on the steel, the magnetic field B must increase proportionately with the square root of y. The coils and pole pieces of the magnet system are located to produce a magnetic field that varies in accordance with this equation.

The magnetic field required to contain the molten metal can be determined by equating $p_m$ and $p_y$, $$p_m = p_y$$

and solving for the magnetic field, B, $$B = (2\mu_o g\rho y)^{\frac{1}{2}}$$

The present invention overcomes the problems of previous methods by using at least two separate magnets, each specifically adapted to serve the separate purposes of levitating the molten metal and confining it. By separating the tasks of levitation and confinement, separate magnets can be utilized that accomplish these tasks with a minimum energy requirement thereby enhancing the efficiency of electromagnetic casting of metals, minimizing stray eddy currents and reducing safety hazards. When using separate magnets for levitation and confinement, a means to support the edges of the cast metal sheet must be employed and a third, or edge support magnet, can be used for this task.

The invention is described in terms of casting steel sheets although the method is equally applicable to other metals such as aluminum, aluminum alloys, copper, copper alloys, but not limited to these, and other shapes, e.g. rods.

Referring to FIG. 1, there is depicted the present invention as used in a casting process for forming sheets of metal. The present invention includes a magnet system 10 having a top 12 and bottom 14. Magnet system 10 includes a yoke 11 made of a magnetic material of high permeability and low power loss for high frequency fields. Such a material is ferrite. The magnet system 10 generates magnetic fields that define a central region within the magnet system 10. Magnet system 10 has a central aperture 16 connecting the top 12 and bottom 14. Metal in liquid form 20 is supplied by a feed system which may include a tundish 18 located above and adjacent to central aperture 16 of magnet system 10. Tundish 18 allows metal in liquid form 20 to flow by gravity or other means to the central region of the magnet system 10 via aperture 16.

Start-up of the casting process may be accomplished with a leader sheet (not shown) using the method described in the copending application "Electromagnetic Confinement for Vertical Casting or Containing Molten Metal" by Lari, et al.

Figure 2:
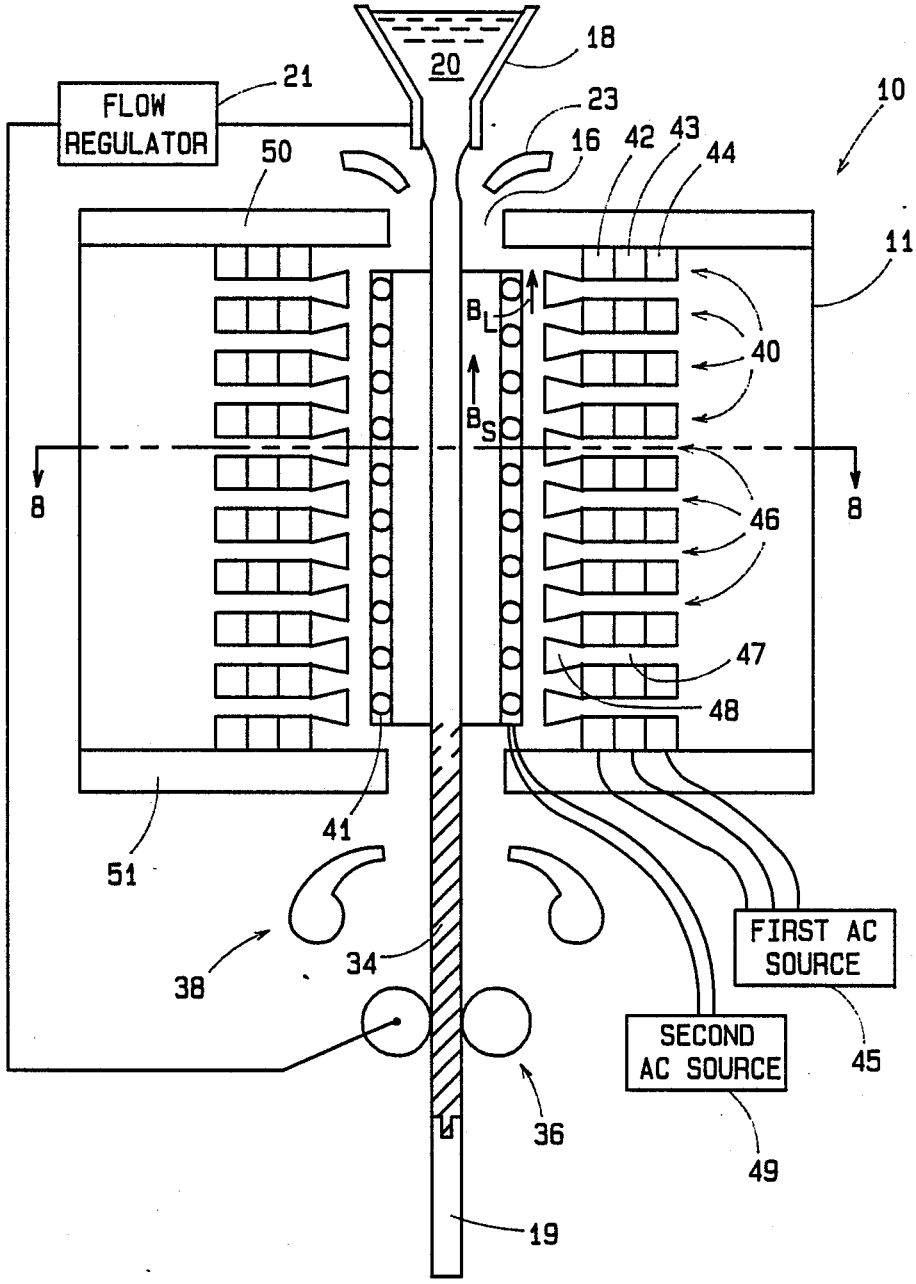
FIG. 2 depicts a cross section of the present invention.

Referring to FIG. 2, the feed system may include a mechanical or electromagnetic flow regulator 21 adapted to convey metal in liquid form 20 to the magnet system 10 at a desired rate. The magnetic field of magnet system 10 levitates and confines the metal in liquid form 20 with generally vertical boundaries within the central region of magnet system 10 so that as the metal cools, the metal will be cast into a solid continuous sheet having a smooth surface. Cooling of the metal in liquid form 20 while it is in the magnet system 10 is provided by first cooling jets 23 located adjacent aperture 16. First cooling jets 23 spray streams of nitrogen, argon, carbon dioxide, or other suitable gas around the metal in liquid form 20 while it is confined in magnet system 10 in order to solidify the metal while it is being confined inside magnet system 10. The metal in solid form 34 (depicted in FIG. 2 by the shaded region) is carried away from the magnet system 10 by a support mechanism 36 which may be comprised of rollers which engage the metal in solid form 34 by friction. The support mechanism 36 would normally be synchronized with flow regulator 21 associated with the feed system to convey the cast metal sheet away from the magnet at a rate compatible with introduction of metal in liquid form 20 from the tundish 18 to the magnet system 10. Additional cooling can be provided by second cooling jets 38 located beneath magnet system 10. Second cooling jets 38 serve to further cool the metal in solid form 34 by spraying water or gas on it after it leaves magnet system 10.

Figure 3:
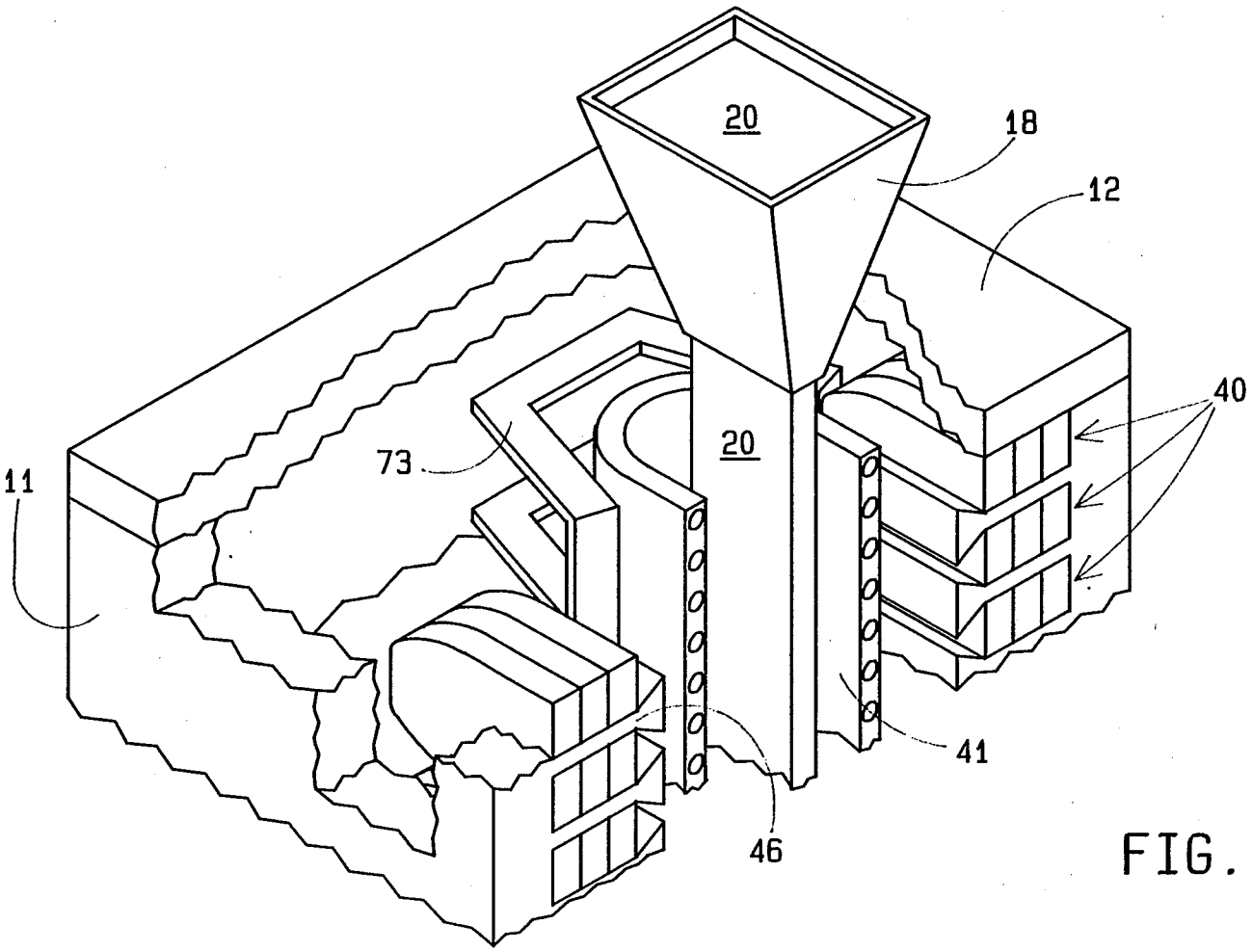
FIG. 3 is a cutaway perspective view of the upper portion of the present invention.

Referring to FIG. 3, there is depicted a perspective view of the upper portion of magnet system 10 with yoke 11 partially cutaway to reveal the coil arrangement. The magnet system 10 of the present invention includes at least two separate electromagnets that operate at different frequencies. These two electromagnets are the levitation magnet and the stabilization magnet. These two separate electromagnets each have separate coils: the levitation coils 40 for the levitation magnet and the stabilization coil 41 for the stabilization magnet. As depicted in FIG. 3, the yoke 11 can serve as yoke for these electromagnets, but is shaped so that portions of the yoke body cooperate with the individual coils of each electromagnet to produce the desired magnetic field. Using the same yoke can simplify magnet construction. However, it is understood that the magnet system of the present invention could be constructed of coils having individual yokes similarly positioned.

The purpose of the levitation magnet is to produce a magnetic force that nearly counterbalances the force of gravity and thus levitates the metal in liquid form 20 within the central region of magnet system 10. Referring to FIG. 2, the levitation magnet includes levitation coils, located on either side of the central region of magnet system 10 where the thin metal sheet is being cast. Each levitation coil includes three individual coil layers 42, 43, 44 that conduct alternating current supplied by a first AC source 45. Each coil layer 42 43, and 44 carries alternating current set 120° out-of-phase with the currents in the other two layers in order to produce a traveling wave magnetic field $B_L$ moving vertically upward.. The left side of the coil depicted in FIG. 2 illustrates the current densities in each layer. The current densities $j_1$ and $j_2$ ($j_1=0.618j_2$) are illustrated for each layer of the levitation coil windings around each pole at an instant of time. This arrangement of windings produces one wavelength of the magnetic field traveling wave $B_L$.

The levitation coil layers 42, 43, and 44 are connected to a first AC source 45 that supplies three-phase alternating current at a frequency set low enough in order to provide full penetration of the magnetic field into the sheet of metal in liquid form 20. A typical frequency would be in the range of from approximately 60 Hz to 1 KHz, however, both higher and lower frequencies may be used. (Although a magnetic field traveling wave could be produced with only two coil layers with current 180° out-of phase, in the preferred embodiment, three coil layers 120° out-of phase are used. Additional coil layers, could also be used to produce a traveling wave; for example, four coil layers 90° out-of phase). The levitation coils 40 would typically be designed with appropriate cooling, as is well known in the art.

The levitation magnet also includes a series of levitation poles 46 connected to yoke 11. In this embodiment, the series of levitation poles 46 extend from yoke 11 toward the central region and are encircled by windings of the levitation coils 40. Each levitation pole may include a tooth stem portion 47 and tooth cap portion 48. The shape of the tooth stem and tooth cap portions enhances the shaping of the magnetic field $B_L$ by locating the field as close as possible to the central region of magnet system 10. The embodiment depicted in FIG. 2 shows ten levitation poles on each side, however, a greater or lesser number could be used.

The amplitude and/or frequency of the current in the levitation coils 40 can be adjusted to produce the correct force. Because the field from the levitation coils 41 completely penetrates the sheet of metal in liquid form 20, the force is uniform everywhere except near the edges of the sheet where the currents induced in the sheet turn around and the horizontal component of the current vanishes. Near the edges of the sheet, supplementary levitation must be provided, as explained later. Because the frequency of the current in the levitation coils 40 is low, the electromagnetic heating of the sheet of metal in liquid form 20 by this field is not excessive.

Working in cooperation with the levitation magnet is the stabilization magnet. One of the problems confronting previous electromagnetic casting system designs is that the electromagnetic energy used to retain the molten metal also tended to heat it, thereby inhibiting the solidification and casting process. The present invention overcomes this problem by minimizing the electromagnetic energy used to retain a liquid metal with a vertical boundary. The levitation magnet uses a relatively low frequency magnetic field traveling wave to nearly offset the force of gravity. However, at this relatively low energy level, the vertical surface of the liquid metal would be uneven and unsuitable for the casting of metal sheets of high quality. The stabilization magnet overcomes this problem.

The purpose of the stabilization magnet is to produce a magnetic force $B_s$ that stabilizes the molten metal in liquid form 20 and provide it with a smoothly uniform vertical surface. Because the force of gravity is offset by the levitation magnet, the magnetic field from the stabilization magnet need only be strong enough to provide the molten metal sheet with a smooth, stable vertical surface suitable for casting. Hence, the electromagnetic heating of the metal in liquid form 20 by the two magnets can be reduced thereby enhancing the casting process.

The stabilization magnet includes a stabilization coil 41 which may be an elongated solenoid in configuration as illustrated in FIGS. 2 and 3. The stabilization coil 41 is connected to second AC power source 49 which supplies alternating current at a frequency set high enough to limit the penetration of the magnetic field into the metal in liquid form 20 to just a small fraction (less than 0.25 of the width of the molten metal sheet). Increasing alternating current frequencies provide smaller penetration of the magnetic field into the metal on liquid form 20 due to eddy current shielding. A typical frequency would be in the range of approximately 100 KHz to 400 KHz, however, both higher and lower frequencies may be used. The stabilization coil 41 would typically be designed as a high frequency coil with appropriate cooling, as is well known in the art.

The stabilization magnet also includes upper pole 50 and lower pole 51 connected by yoke 11. The high frequency current in stabilization coil 41 magnetizes yoke 11 and produces a high frequency alternating vertical magnetic field between the upper pole 50 and lower pole 51. This field is vertical and parallel to the vertical surface of the metal in liquid form 20 retained in the central region of the magnet system 10. The magnetic field produces an even horizontal confining force on the metal in liquid form 20 that smooths and stabilizes the vertical surface of the metal.

Figure 4:
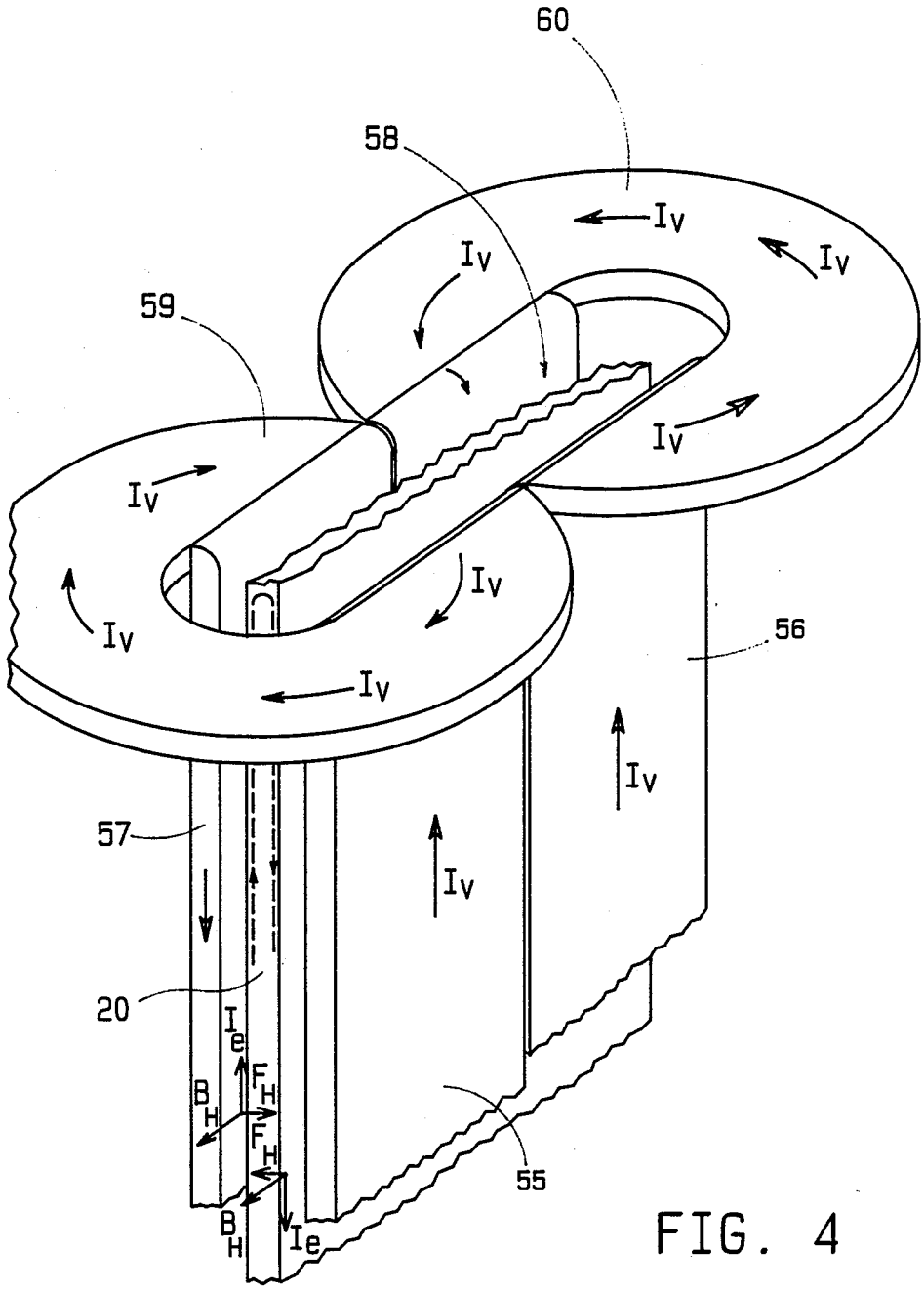
FIG. 4 is a perspective view of the upper portion of an alternate embodiment of the stabilization coil of the present invention.
Figure 5:
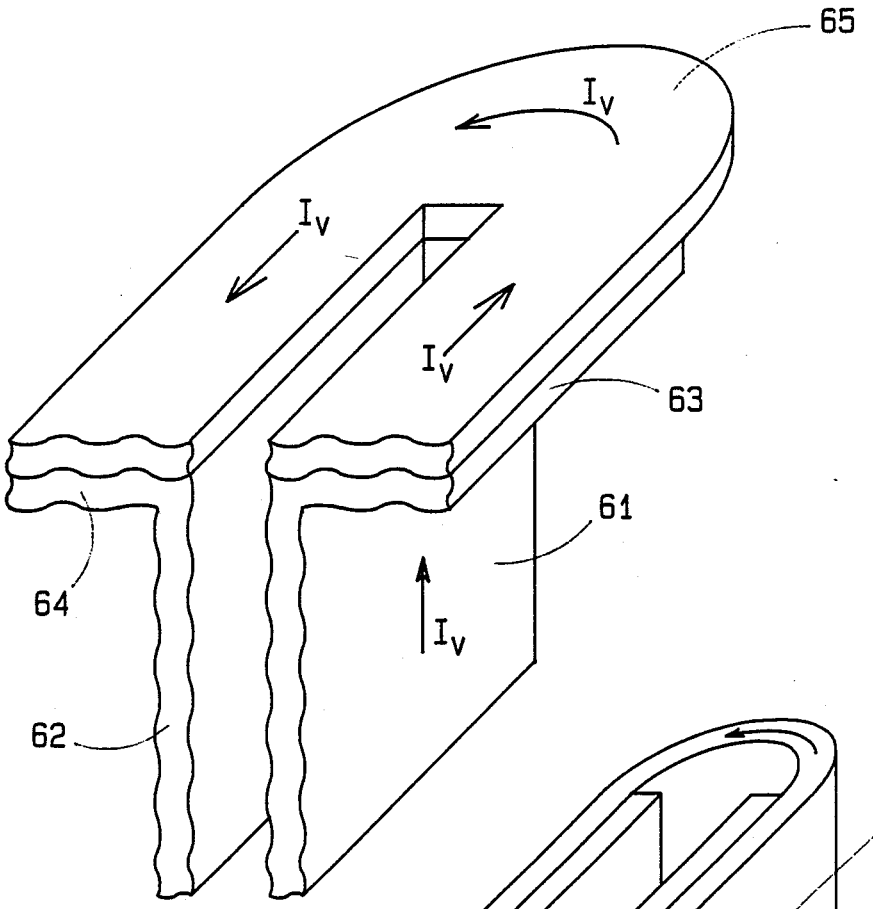
FIG. 5 is a perspective view of the upper portion of an alternate embodiment of the stabilization coil of the present invention.
Figure 6:
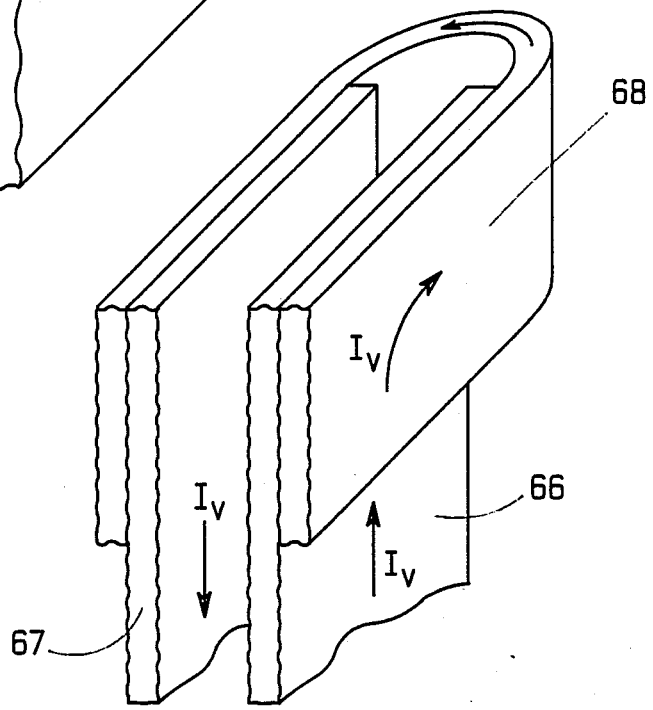
FIG. 6 is a perspective view of the upper portion of an alternate embodiment of the stabilization coil of the present invention.

FIGS. 4, 5, and 6 depict alternate embodiments of the stabilization magnet. In these embodiments, the stabilization magnets shown produce a horizontal magnetic field that is parallel to the plane of the vertical surface of the molten metal. These embodiments each include a stabilization coil that carries alternating current in a vertical direction adjacent to the vertical boundary of the region in which the molten metal is retained. These embodiments differ in how the current is allowed to loop around at the ends of the coil.

As depicted in FIG. 4, with the stabilization coil carrying alternating current $I_v$ in a vertical direction, vertical eddy currents $I_e$ are set up in the surface of the liquid metal. This produces a force $F_H$ on the liquid metal surface directed inward thus confining it with a smooth, stable vertical boundary similar to the coil arrangement on the previously described embodiment that carries a current in a horizontal direction and sets up horizontal eddy currents in the metal. In an embodiment depicted in FIG. 4, the stabilization coil includes main coil sections 55, 56, 57, and 58 that carry the alternating current $I_v$ supplied by a current source. A metal in liquid form 20 would be primarily supported by a levitation magnet as previously described. The stabilization coil of this embodiment also includes loop sections 59 and 60 to connect sections 55 to 57 and 56 to 58, respectively, thereby providing a complete loop for the current $I_v$ traveling in the direction of the arrows.

FIG. 5 depicts another embodiment for a stabilization coil having a horizontal field. In this embodiment, the main coil sections 61 and 62 have horizontal extensions 63 and 64 respectively. On top of horizontal extensions 63 and 64 is loop section 65. Loop section 65 makes electrical contact with horizontal extensions 63 and 64 and serves to conduct current $I_v$ from one horizontal extension to the other thereby completing the current loop as in the previous embodiment.

FIG. 6 depicts still another embodiment of a stabilization coil having a vertical current $I_v$. In this embodiment, main coil extensions 66 and 67 are electrically connected by loop 68. Loop 68 makes electrical contact with main coil sections 66 and 67 in a vertical position.

Figure 7:
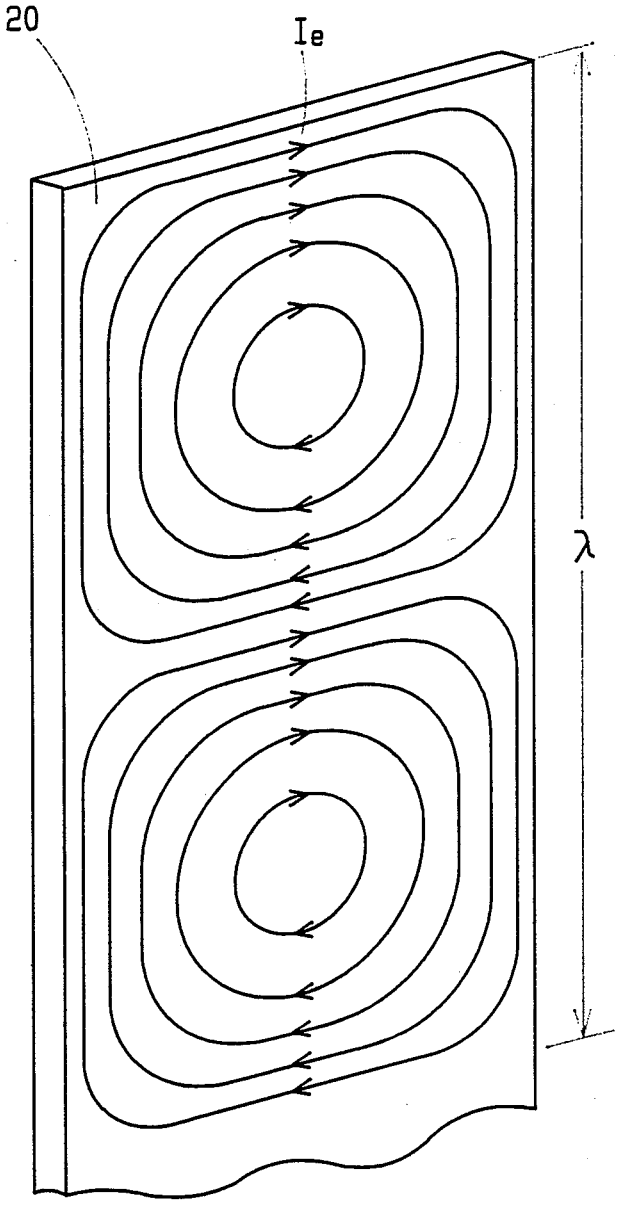
FIG. 7 depicts the eddy current flow in a sheet of metal.

As described above, the levitation and stabilization magnets serve to produce magnetic fields that can retain a molten metal to a region having a smooth, stable vertical boundary and therefore has application to the continuous casting of thin sheets of metal. When used to retain molten metal in the form of a thin sheet, it is necessary to account for the lack of support of the molten metal at the edges of the sheet. At the edges, the eddy currents $I_e$ reverse and the forces of the levitation magnet vanish, as shown in FIG. 7. Accordingly, the present invention provides means for edge support.

Figure 8:
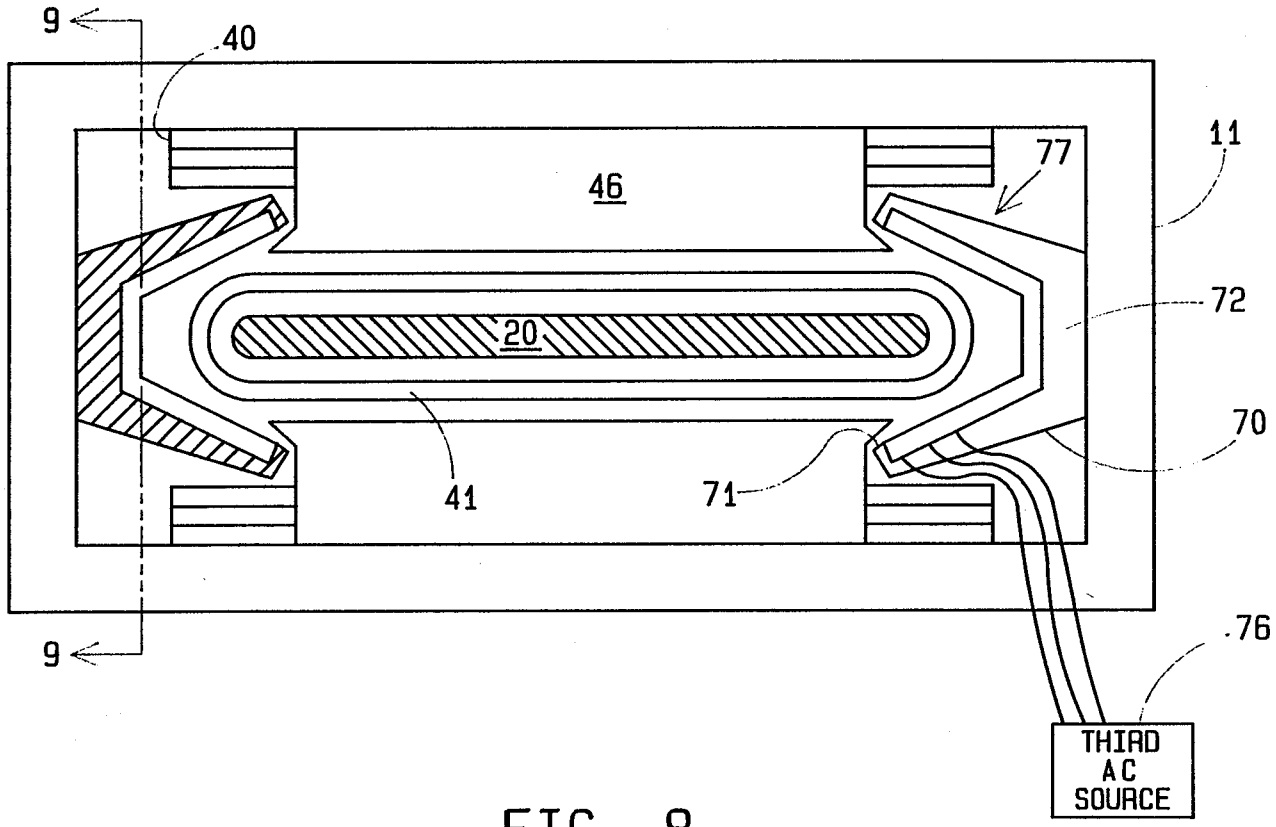
FIG. 8 is a horizontal sectional view taken along line 8—8 of FIG. 2.
Figure 9:
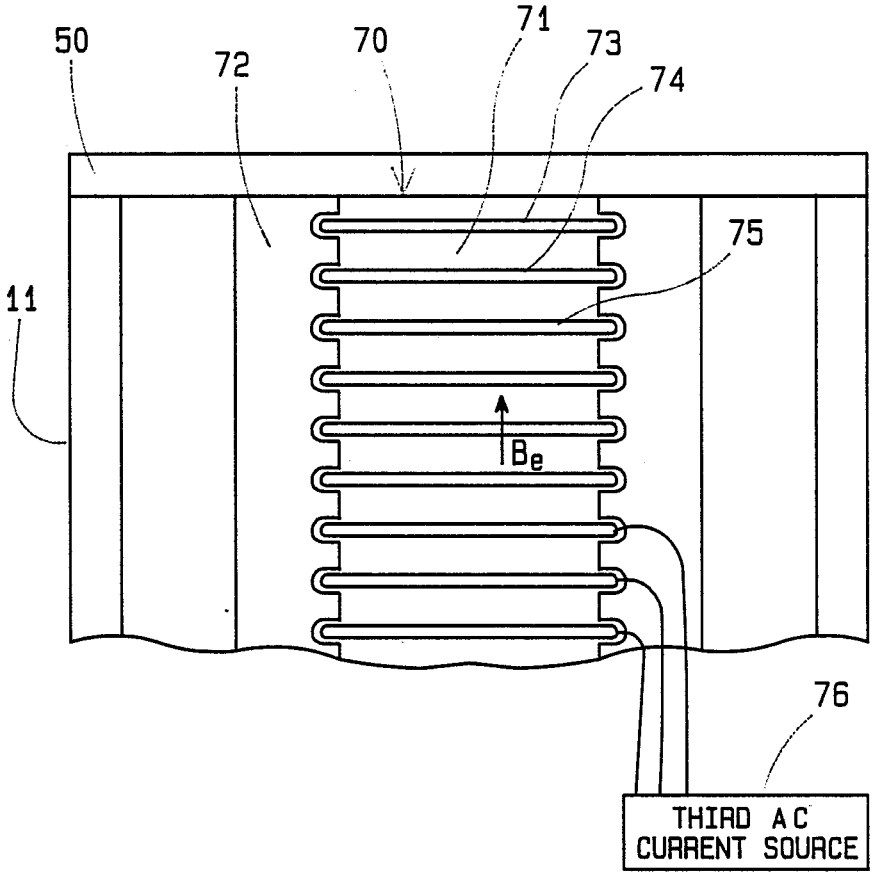
FIG. 9 is a sectional view of the present invention along line 9—9 of FIG. 4.

Referring to FIG. 8, the edge support means in this embodiment includes a pair of magnets called the edge support magnets 70. Each edge support magnet 70 is located adjacent the edge of the metal sheet being cast (one edge support magnet on each edge). Edge support magnets include edge support poles 71 connected by yoke 72 which may be an extension of yoke 11. FIG. 9 is a sectional view of the upper portion of the edge support magnet taken along line 9—9 in FIG. 8. Referring to FIG. 9, the edge support magnet 70 also includes three edge support coils 73, 74, and 75. The phases of the currents in edge support coils 73, 74, and 75 are chosen 120° apart in order to produce a traveling wave magnetic field $B_e$ moving vertically upward.

The edge support coils 73, 74 and 75 are connected to a third AC current source 76 which supplies threephase alternating current at a frequency that provides a degree of penetration of the magnetic field into the metal in liquid form 20. Increasing alternating current frequencies provide smaller penetration of the magnetic field into the metal in liquid form 20. A typical frequency would be in the range of from approximately 50 kHz to 400 kHz, however, both higher and lower frequencies may be used. The edge support coils 73, 74 and 75 would typically be designed as high frequency coils with appropriate cooling, as is well known in the art.

The purpose of the edge support magnets is to augment the force of the levitation magnet near the edges of the sheet of metal in liquid form 20 where the force of the levitation magnet vanishes. The levitating force from the edge support magnet is maximum at the edge and diminishes away from the edge. As suggested by FIG. 8, the edge support yoke 72 and windings of the edge support coils 73, 74 and 75 may be shaped with spread out yoke arms 77 so that the field $B_e$ tapers off away from the edge of the central region.

Figure 10:
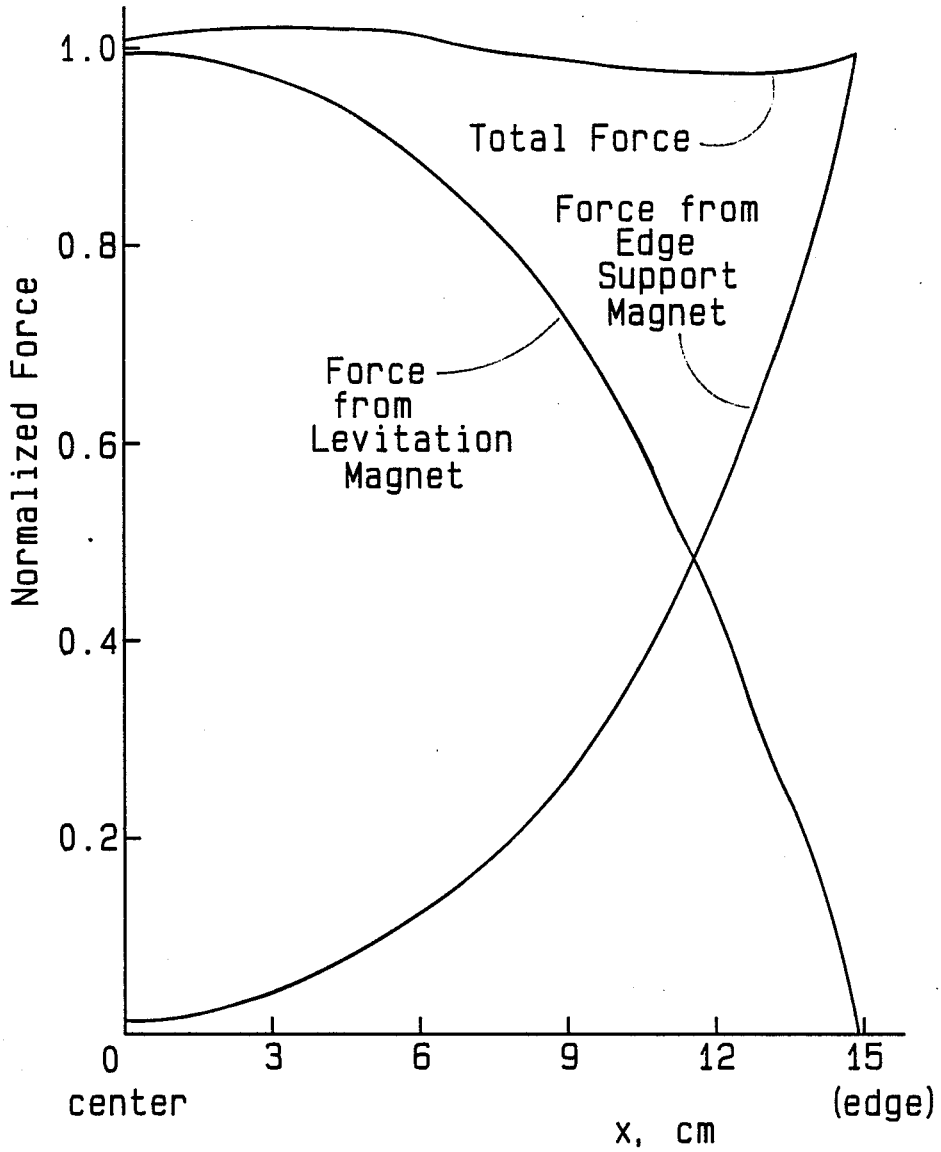
FIG. 10 is a graph showing the calculated total force of the magnets as a function of the horizontal position in the liquid metal sheet.

The relationship between the levitation magnet and the edge support magnet is shown in the graph of FIG. 10. The force of the levitation magnet tapers off near the edges where the induced eddy currents reverse. The force of the edge support magnet is stronger at the edges. The total force is the sum of the levitation magnet force and the edge confinement magnet force. The total force is nearly even over the width of the sheet.

The correct choice of the size and shape of the edge support coils 73, 74 and 75 and of the edge support yoke 72 and the correct choice of the frequency and amplitude of the current supplied by the third AC source 76 result in a combined levitating force from the levitation magnet and the edge support magnets which is uniform within the metal sheet 20 to within a few per cent and is suitable for casting. The action of the edge support magnets 70 results in additional electromagnetic heating near the edges of the metal sheet 20. Hence, additional cooling by a cooling gas or other means may be required near the edges.

Figure 11:
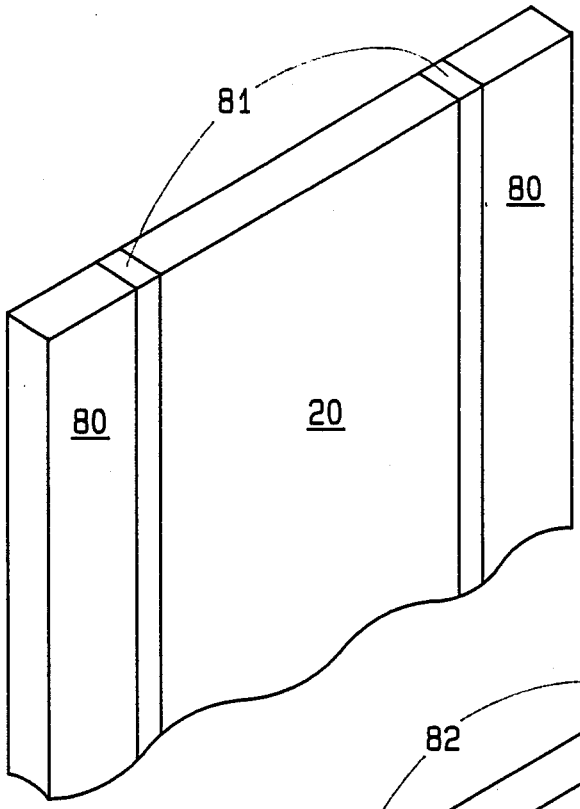
FIG. 11 is a perspective view of the upper portion of an alternative embodiment of the edge confinement means.

FIG. 11 depicts an alternate embodiment of the edge support means. The levitating force in the embodiment depicted in FIG. 11 is extended all the way to the edge of the molten metal sheet through the use of high-conductivity edge strips rather than by edge support magnets. The strips may be cooled by internal water passages. Referring to FIG. 11, there is shown an isometric view of a sheet of metal in liquid form 20 with a strip of metal or ceramic of high electrical conductivity 80 at each edge. A thin layer of electrically conducting material 81 separates the metal in liquid form 20 from the high conductivity strip 80. The high conductivity strips 80 and thin layers 81 are attached to and travel with the sheet of metal in liquid form 20. Suitable means would feed the strips 80 and thin layers 81 at the top of the magnet system 10 and disconnect them from the metal sheet after it solidifies.

Figure 12:
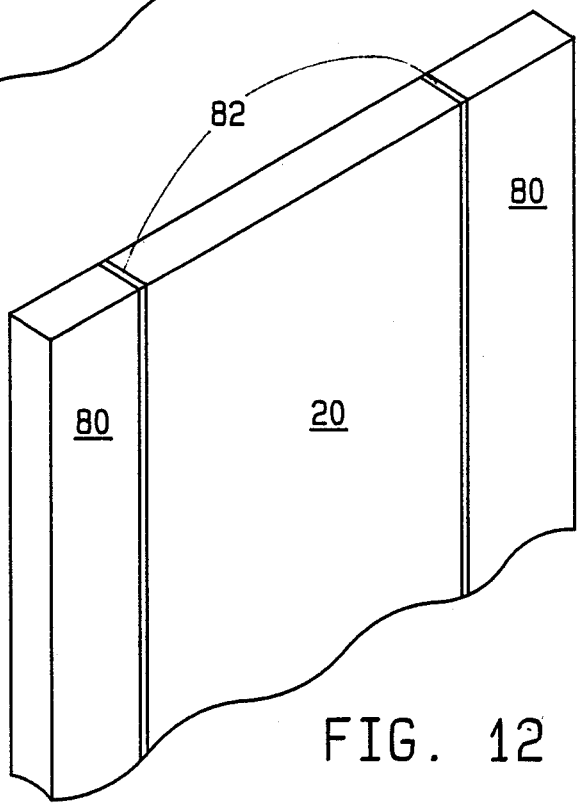
FIG. 12 depicts another alternative embodiment of the edge confinement means.

In another alternate embodiment of the edge support means, as depicted in FIG. 12, the strips 80 could be stationary and separated from the metal in liquid form 20 by a thin layer of liquid 82 as depicted in FIG. 12. The thin layer of liquid 82 would carry current between the strip 80 and the sheet of metal in liquid form 20 but permit the free relative movement between the metal in liquid form 20 and strip 80. Any viscous effects at the edge could be corrected by appropriate spatial variation of the levitating force with respect to the gravitational force.

With the high conductivity strips 80 present, the current induced in the metal sheet of liquid form 20 by the levitation magnet is uniform all the way to the edge of the sheet, and the levitating force produced by the levitation magnet is also uniform thereby obviating the need for the edge support magnets of the previous embodiment. The thin layers 81 or 82 prevent the metal of the high conductivity strip 80 from alloying with the metal is liquid form 20.

Figure 13:
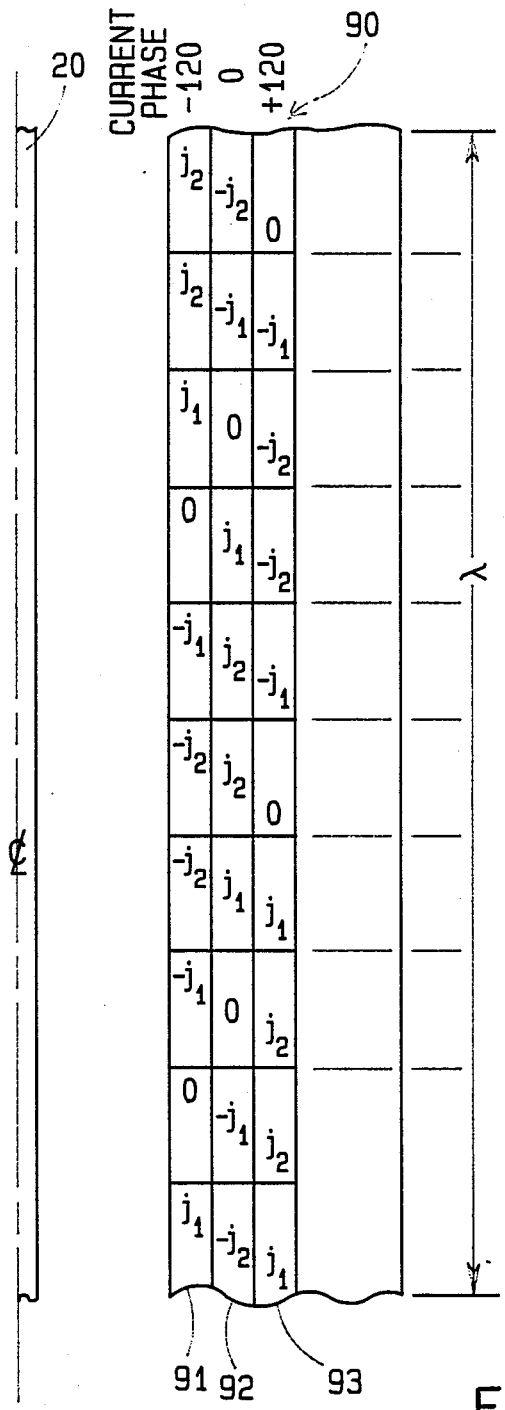
FIG. 13 depicts an alternate embodiment of the levitation magnet.
Figure 14:
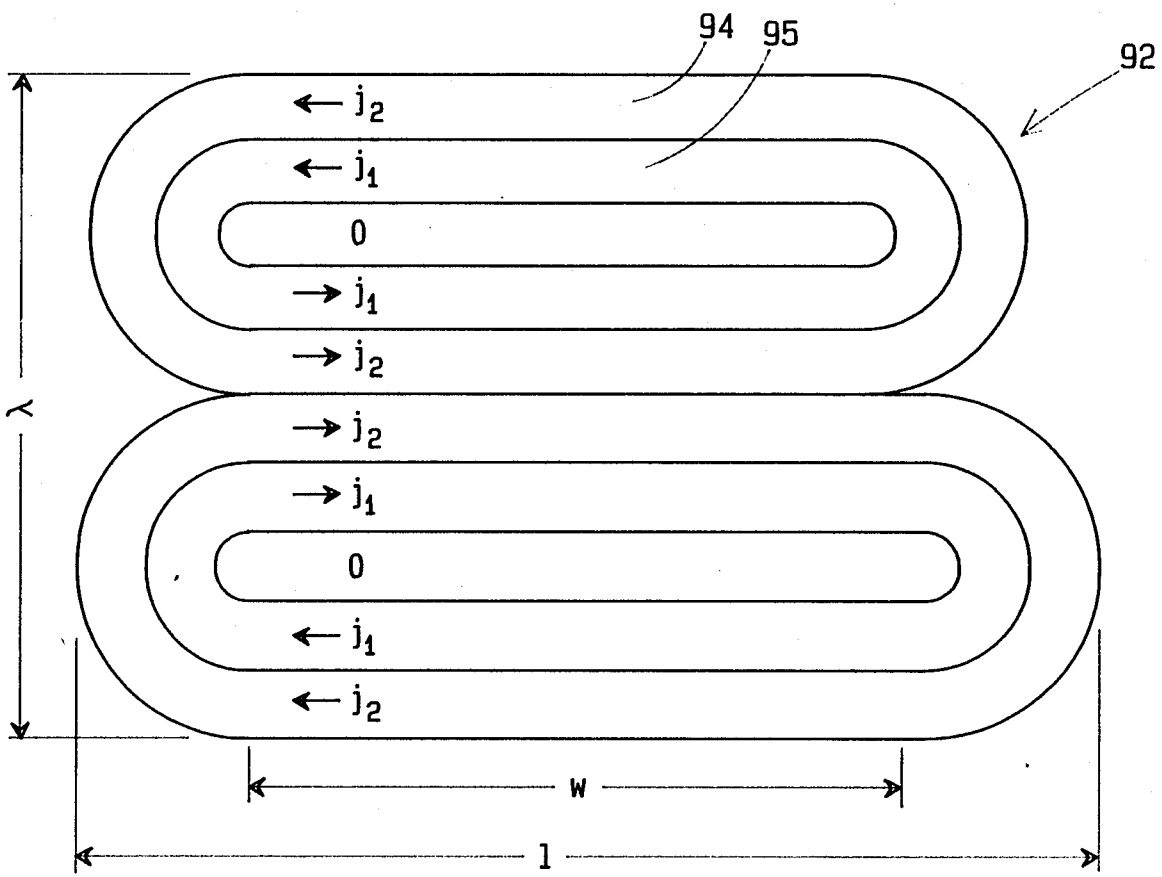
FIG. 14 is a side view of one nested coil layer of FIG. 13.

Another embodiment of the levitation magnet of the present invention is shown in FIGS. 13 and 14. The traveling wave magnetic field is produced by coil 90, which includes three coil layers 91, 92 and 93, as in the previous embodiment. Each of these coil layers is a nested pair of racetrack coils. Referring to FIG. 14, one coil layer 92 of coil 90 is shown as a "nested" pair of race track coils 94 and 95 of length, 1, which is larger than the molten sheet width, w. Several pairs of such nested coil arrangements may be used on each side of the levitation magnet to make up each coil layer. The current densities, $j_1$ and $j_2$, and their directions are shown in FIGS. 13 and 14. Yoke 99 is located behind the coil 90. To produce a uniform time averaged vertical force on the liquid metal, it is desirable to have a cosine distribution of the horizontal magnetic field. This geometry of the coils and ratio of current densities in the inner and outer coil of the nested pair give the best cosine current distribution in the vertical direction. The resulting time averaged vertical force density just inside the surface of the liquid metal is uniform to 0.09 percent over the entire surface.

Coil layers 90 could also be made of four nested coils which would approximate the cosine current distribution more exactly than the two coils. The ratio of current densities would be 1.0, 0.879, 0.653, and 0.347 in the four coils and give a time averaged vertical force density more uniform than the two coil approximation. This concept could be extended to any number of coils. The field strengths, and hence the forces, from the different magnets can be controlled by signals from sensors measuring the sheet thickness and velocity, the temperature of the metal, and the ferrostatic pressure.

The embodiments of the invention in which an exclusive property or privilege is claimed are defined as follows:

1. A casting apparatus for producing a magnetic field that can retain a metal in liquid form in a region with a smooth vertical boundary comprising:

a levitation means located adjacent a vertical side of the region, said levitation means capable of producing a low frequency alternating magnetic field that can levitate a metal in liquid form in the region with a vertical boundary;

stabilization means located adjacent the vertical side of the region, said stabilization means capable of producing a high frequency alternating magnetic field that can stabilize and define the vertical surface of a metal in liquid form being held in the region by said levitation means.

2. The apparatus of claim 1 in which said levitation means is a levitation magnet capable of producing a low frequency magnetic field wave traveling upward.

3. The apparatus of claim 2 in which said stabilization means is a stabilization magnet capable of producing a high frequency magnetic field that can penetrate a metal only a small fraction of the thickness of the metal.

4. The apparatus of claim 3 in which said levitation magnet and said stabilization magnet are capable of producing magnetic fields that define a central region in the apparatus in which a metal in liquid form can be retained with a smooth vertical boundary.

5. The apparatus of claim 4 including edge confinement means located adjacent the edges of the central region defined by the magnetic fields produced by said levitation magnet and said stabilization magnet, said edge confinement means constructed and adapted to support the edges of a metal in liquid form confined in the central region by said levitation magnet and said stabilization magnet.

6. The apparatus of clam 5 in which said levitation magnet, said stabilization magnet, and said edge confinement means are particularly adapted for the continuously casting of metal and further wherein said levitation magnet, said stabilization magnet, and said edge confinement means are constructed and adapted to allow a metal in liquid form to be introduced into one end of the central region defined by the magnetic fields of said levitation magnet and said stabilization magnet and a metal in solid form to be removed from the other end of the central region defined by the magnetic fields produced by said levitation magnet and said stabilization magnet.

7. The apparatus of claim 6 in which said levitation magnet comprises:

a series of levitation magnet poles arranged vertically on both sides of the central region;

a yoke connecting said series of levitation magnet poles;

a levitation magnet coil adjacent to said series of levitation magnet poles;

whereby said levitation magnet, with a current applied to said levitation magnet coil by a first alternating current source, can produce a magnetic field traveling wave that can levitate a metal in liquid form and retain the metal in liquid form within the central region with a vertical boundary.

8. The apparatus of claim 7 in which said stabilization magnet comprises:

an upper pole located adjacent the top of the central region;

a lower pole located adjacent to the bottom of the central region;

a yoke connecting said upper pole and said lower pole;

a stabilization magnet coil adjacent to said stabilization magnet yoke and between said upper pole and said lower pole;

whereby said stabilization magnet, with a current supplied to said stabilization magnet coil by a second alternating current source, can produce a magnetic field that can stabilize or smooth the vertical surface of a metal in liquid form confined to the central region by said levitation magnet.

9. The apparatus of claim 8 in which said, levitation magnet coil includes an arrangement of three coil layers whereby said levitation magnet, with a current supplied to each coil layer of said arrangement of three coil layers from the first alternating current source 120° out-of-phase with the currents carried by the other two coil layers of said arrangement of three coil layers, is capable of producing a magnetic field wave traveling vertically upward whereby a metal in liquid form can be confined to the central region with a vertical boundary.

10. The apparatus of claim 5 in which said edge confinement means comprises edge support magnets located adjacent the edges of the central region defined by the magnetic fields produced by said levitation means and said stabilization means.

11. The apparatus of claim 10 in which each of said edge support magnets comprises:

a series of edge support poles located adjacent the edges of the central region defined by the magnetic field produced by said levitation magnet and said stabilization magnet;

an edge support yoke connecting said series of edge support poles; and an edge support coil located adjacent said edge support yoke, said edge support coil comprised of three coil layers;

whereby said edge support magnet, with a current supplied to each coil layer of said edge support coil from a third alternating current source 120° out-of-phase with the currents carried by the other two coil layers of said edge support coil, is capable of producing a magnetic field wave traveling vertically upward that can retain the edges of a metal in liquid form confined to the central region defined by the magnetic fields produced by said levitation magnet and said stabilization magnet.

12. The apparatus of claim 6 in which said levitation magnet includes at least two nested race track coils located adjacent the central region defined by the magnetic fields produced by said levitation magnet and said stabilization magnet, said pair of nested race track coils having a length greater than the width of the central region.

13. The apparatus of claim 8 in which said stabilization magnet is capable of producing a high frequency vertical magnetic field.

14. The apparatus of claim 8 in which said stabilization magnet is capable of producing a high frequency horizontal magnetic field.

15. The apparatus of claim 14 in which said stabilization magnet yoke includes:

main coil sections located adjacent to the central region and capable of carrying high frequency alternating current from a current source in a vertical direction parallel to the vertical boundary of the central region; and loop sections connecting said main coil sections.

16. The apparatus of claim 5 in which said edge confinement means comprises:

high conductivity edge strips located at the edges of the central region defined by the magnetic fields of said levitation magnet and said stabilization magnet, said high conductivity edge strips being capable of supporting a metal in liquid form at the edges of the central region defined by the magnetic fields of said levitation magnet and said stabilization magnet.

17. The apparatus of claim 16 in which said high conductivity edge strips are separated from the central region defined by the magnetic fields produced by said levitation magnet and said stabilization magnet by a thin layer of electrically conducting material.

18. The apparatus of claim 17 in which said levitation magnet, said stabilization magnet, and said edge confinement means are particularly adapted for the continuously casting of metal and further wherein said levitation magnet, said stabilization magnet, and said edge confinement means are constructed and adapted to allow a metal in liquid form to be introduced into one end of the central region defined by the magnetic fields of said levitation magnet and said stabilization magnet and a metal in solid form to be removed from the other end of the central region defined by the magnetic fields produced by said levitation magnet and stabilization magnet.

19. The apparatus of claim 18 in which said high conductivity edge strips are constructed and adapted to be capable of moving generally with a metal being cast.

20. The apparatus of claim 18 in which said thin layer of electrically conducting material is capable of allowing relative movement between said high conductivity edge strips and a metal being retained in the central region defined by said levitation magnet and said stabilization magnet.

21. The apparatus of claim 5 including:

a feed system located adjacent to and above the top end of the central region defined by the magnetic fields of said levitation magnet and said stabilization magnet, said feed system constructed and adapted to introduce metal in liquid form into the central region.

22. The apparatus of claim 21 including:

a flow regulator constructed and adapted to be responsive to the speed or dimensions of metal in solid form being removed from the central region defined by said levitation magnet and said stabilization magnet, said flow regulator being capable of regulating the flow of metal in liquid form from said feed system to the central region.

23. The apparatus of claim 21 in which said feed system includes a tundish.

24. The apparatus of claim 21 including a support mechanism located adjacent to and below the central region defined by the magnetic fields produced by said levitation magnet and said stabilization magnet, said support mechanism constructed and adapted to convey a metal in solid form from the central, region.

25. The apparatus of claim 21 including first cooling jets located adjacent to and above the central region defined by the magnetic fields of said levitation magnet and said stabilization magnet, said first cooling jets constructed and adapted to cool a metal in liquid form confined in the central region by spraying gas.

26. The apparatus of claim 25 including second cooling jets located adjacent to and below the central region defined by the magnetic fields of said levitation magnet and said stabilization magnet, said second cooling jets constructed and adapted to cool a metal in solid form after the metal has been removed from the central region by spraying gas or liquid on the metal.

27. The apparatus of claim 4 in which said levitation magnet is capable of producing an alternating magnetic field having a frequency in the range of approximately 60 hertz to 1 kilohertz.

28. The apparatus of claim 4 which said stabilization magnet is capable of producing an alternating magnetic field having a frequency in the range of approximately 100 kilohertz and 400 kilohertz.

29. The apparatus of claim 10 in which said edge support magnet is capable of producing an alternating magnetic field having a frequency in the range of approximately 50 kilohertz and 400 kilohertz.

30. A method for confining metal in liquid form to a region having a smooth vertical boundary comprising the steps of:

producing vertical traveling waves of a low frequency alternating magnetic field capable of levitating a metal in liquid form within the region;

establishing a stable vertical boundary of the region with a high frequency alternating magnetic field; and introducing a metal in liquid form to the region;

whereby said metal in liquid form can be confined in a region having a smooth vertical boundary.

31. The method of claim 30 adapted for the continuous casting of molten metal into solid metal further comprising the step of:

removing the metal from the region after the metal has solidified.

32. The method of claim 31 further comprising the step of:

producing vertically traveling waves of a high frequency alternating magnetic field at the edges of the region whereby the edges of a metal in liquid form can be confined in the region.

33. The method of claim 30 in which the low frequency alternating magnetic field is between approximately 60 hertz and 1 kilohertz.

34. The method of claim 30 in which the high frequency alternating magnetic field is between approximately 100 kilohertz and 400 kilohertz.

35. The method of claim 32 in which the high frequency magnetic field at the edges of the region is between approximately 50 kilohertz and 400 kilohertz.

36. The method of claim 31 further comprising the step of:

confining the edges of a metal in liquid form with high conductivity edge strips.

37. The method of claim 31 further comprising the step of:

regulating the flow of metal in liquid form to the region in response to measurement of the rate that metal in solid form is removed from the region.

38. The method of claim 37 further comprising the step of:

spraying gas on a metal confined in the region.

39. The method of claim 38 further comprising the step of:

spraying gas or liquid on a metal in solid form after the metal has been removed from the region.

* * * * *